United States Patent [19]

Morita et al.

[11] 4,236,293

[45] Dec. 2, 1980

[54] METHOD ~~AND~~ APPARATUS FOR FORMING SPACE SECTIONS IN A SLIDE FASTENER

[75] Inventors: Toyoo Morita; Hiroshi Oura, both of Kurobe, Japan

[73] Assignee: Yoshida Kogyo K.K., Tokyo, Japan

[21] Appl. No.: 974,616

[22] Filed: Dec. 29, 1978

[30] Foreign Application Priority Data

Dec. 30, 1977 [JP] Japan ..... 52/158063

[51] Int. Cl.[3] ..... B23P 19/04

[52] U.S. Cl. ..... 29/408; 29/770

[58] Field of Search ..... 29/33.2, 408, 410, 426, 29/427, 766, 767, 768, 770

[56] References Cited

U.S. PATENT DOCUMENTS

| | | | |
|---|---|---|---|
| 2,394,197 | 2/1946 | Morin | 29/770 X |
| 3,685,130 | 8/1972 | Doerter | 29/408 |
| 3,689,980 | 9/1972 | Oyama | 29/408 |
| 3,852,869 | 12/1974 | Shimai | 29/408 |
| 4,062,100 | 12/1977 | Heimberger | 29/770 X |
| 4,091,532 | 5/1978 | MacFee | 29/770 |

FOREIGN PATENT DOCUMENTS 48-32222 10/1973 Japan .

*Primary Examiner*—Ervin M. Combs

*Attorney, Agent, or Firm*—Hill, Van Santen, Steadman, Chiara & Simpson

[57] ABSTRACT

A method and apparatus for forming space sections in a continuous length slide fastener chain in which the interlocking elements fastened on the carrier tapes within the section are pressed and deformed with a punch-die unit having a composite punch composed of an outer punch and an inner punch and the thus deformed elements are retained by the punch-die unit in engagement with a pair of grooves on the upper surface of the die and lower surface of the inner punch while the carrier tapes are pulled and displaced by individual grippers from the front of the punch-die unit in an obliquely rearward direction, preferably, at such an angle that the angle between the moving line of the gripper and the center line of the punch-die unit is about a half of the tape-abstracting angle whereby all of the elements within the section can be removed from the carrier tape with a uniform abstracting angle.

9 Claims, 9 Drawing Figures

METHOD AND APPARATUS FOR FORMING SPACE SECTIONS IN A SLIDE FASTENER

BACKGROUND OF THE INVENTION

1. Field of the Invention

The present invention relates to a method and apparatus for forming (space) sections, i.e. sections of a continuous slide fastener chain void of interlocking fastener elements, by removing a predetermined number of securely fastened elements from the carrier tapes of the slide fastener chain.

2. Prior Art

To simplify and facilitate the assembling and finishing of slide fasteners, it is common to work on a slide fastener chain or stringer of a continuous length carrying thereon an uninterrupted row or rows of interlocking elements rather than on slide fastener chains or stringers of a definite product length. It is thus customary to provide element-free sections or so-called "space" sections in the chain at predetermined intervals for enabling mounting sliders and end stops, and thereafter to cut the chain or stringer into individual product lengths. The elements to be removed are pressed and deformed at the leg portions thereof followed by abstracting the carrier tapes from the thus deformed elements.

A method for forming space sections according to the above principle is disclosed in Japanese Patent Publication SHO No. 48-32222. The method of this reference comprises pressing and deforming the elements at the leg portions thereof with a punch-die unit and removing the thus deformed elements from the cores of the carrier tapes by merely displacing the portions of the carrier tapes positioned in front of the punch-die unit transversely at substantially a right angle relative to the direction of the element rows. In this type of a method or apparatus therefor, the abstracting angle, i.e. the angle between the row of the elements and the tape core under movement by pulling, differs from element to element being the largest for the element at the most advanced position and smaller for the succeeding elements so that the elements near or at the rear end of the section are removed with difficulty. If the removal conditions are selected to match the elements at the most advanced position, then they are inadequate for the elements at the rear end. If the removal conditions are selected to match the elements at the rearmost position, then there has been needed an excessively strong force resulting in eventual breakage of the carrier tapes.

SUMMARY OF THE INVENTION

It is therefore an object of the present invention to provide a method and apparatus, according to which or by use of which space sections of a predetermined length can be made in a slide fastener chain or stringer with reliability.

Another object of the invention is to provide a method and apparatus according to which or by use of which removal of all of the elements to be removed for forming a space section can be performed under uniform conditions regardless of the positions of the individual elements within the section.

The method of the invention comprises pressing and deforming a predetermined number of plastic fastener elements securedly fastened to a carrier tape, holding the deformed elements at the positions of pressing, and abstracting the carrier tape from the row of the elements by displacing the carrier tape relatively to the row of elements from the front of the element at the most advanced position to the obliquely rearward direction of the element at the rearmost position. In particular, the angle of displacement of the carrier tape relative to the row of the elements is about a half of the abstracting angle so that removal of all of the elements within a section from the carrier tape can be performed with a uniform abstracting angle of the tape regardless of the positions of the individual elements within the section.

Further, the apparatus of the present invention comprises a punch-pie unit, a tape-abstracting unit positioned at a lateral side of the punch-die unit and having motion coordinated with the punch-die unit, the tape-abstracting unit being composed of a gripper mechanism and a driving mechanism which enables the gripper mechanism to move from the front of the punch-die unit in the obliquely rearward direction to the same. In particular, the tape-abstracting unit is movable in the direction at half the angle of the abstracting angle relative to the longitudinal direction of the punch-die unit. The apparatus is provided with a pair of such tape-abstracting units.

DETAILED DESCRIPTION OF THE PREFERRED EMBODIMENT

Figure 1:
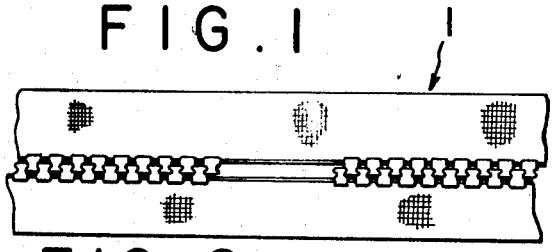
FIG. 1 is a plan view of a finished slide fastener chain provided with a space section.
Figure 2:
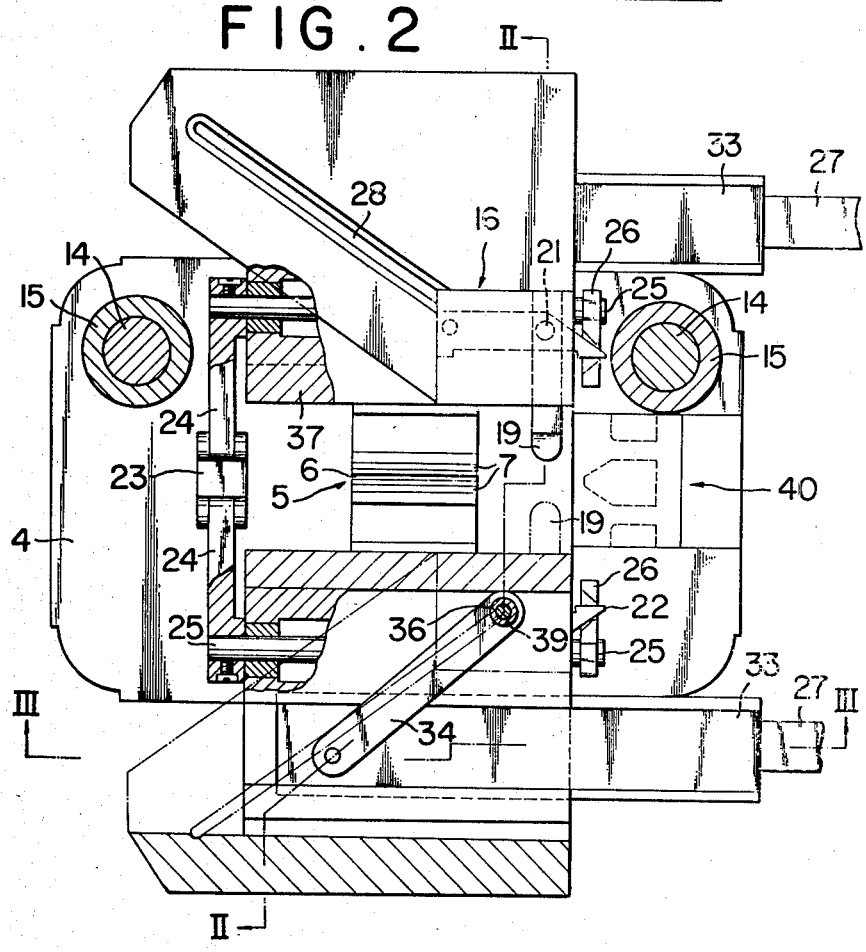
FIG. 2 is a plan view of an apparatus in accordance with this invention for forming space sections partially broken away.
Figure 3:
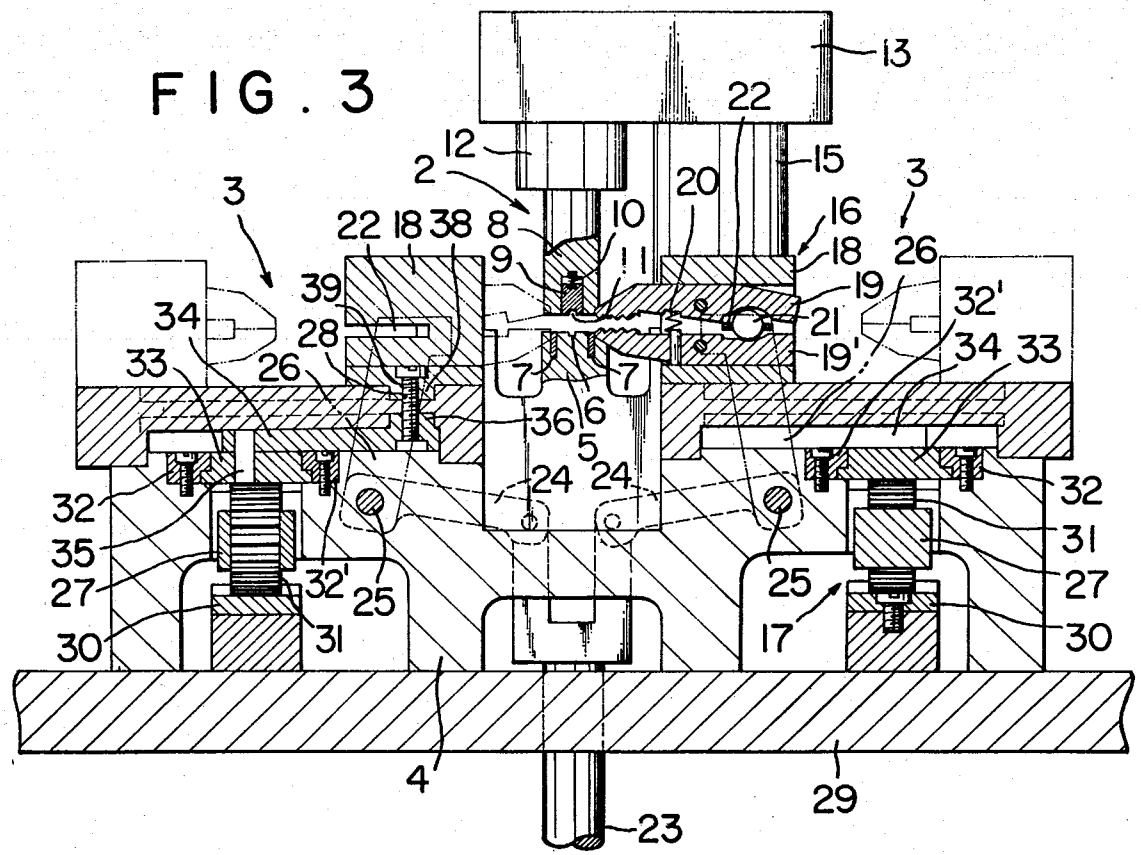
FIG. 3 is a cross sectional view of the apparatus taken along II—II of FIG. 2.
Figure 4:
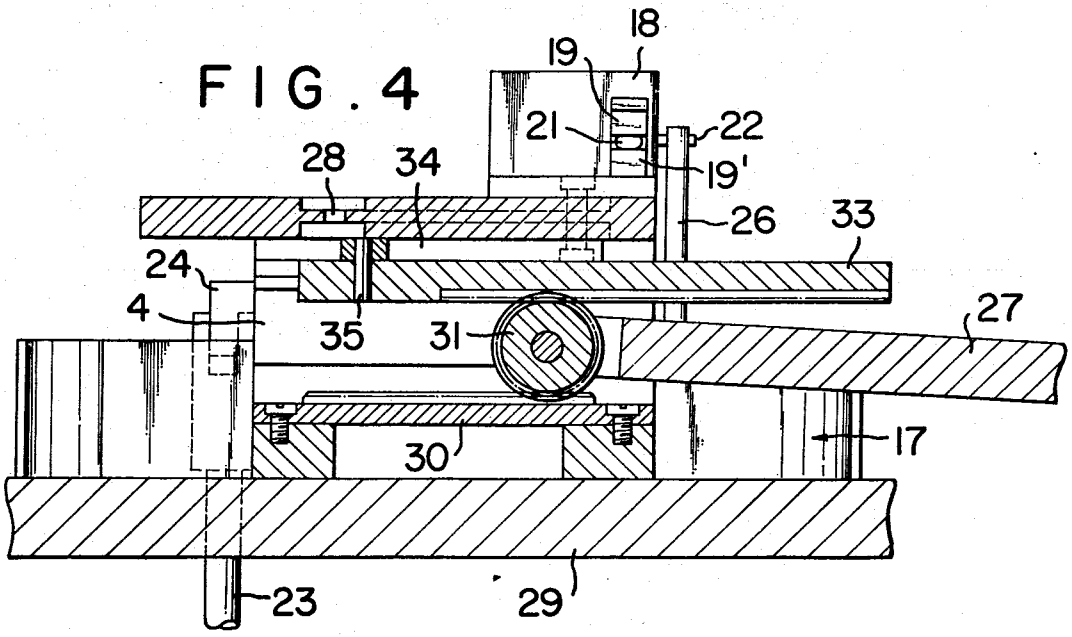
FIG. 4 is a cross sectional view of the apparatus in taken along line III—III of FIG. 2.

The present invention is directed to a method and apparatus for forming a space section in a continuous length slide fastener chain 1 as shown in FIG. 1. The apparatus is illustrated in FIGS. 2 to 4 and comprises a punch-die unit 2 for pressing and deforming the plastic elements and a pair of tape-abstracting units 3, 3 for displacing the carrier tapes in the lateral direction of the punch-die unit 2.

Figure 5:
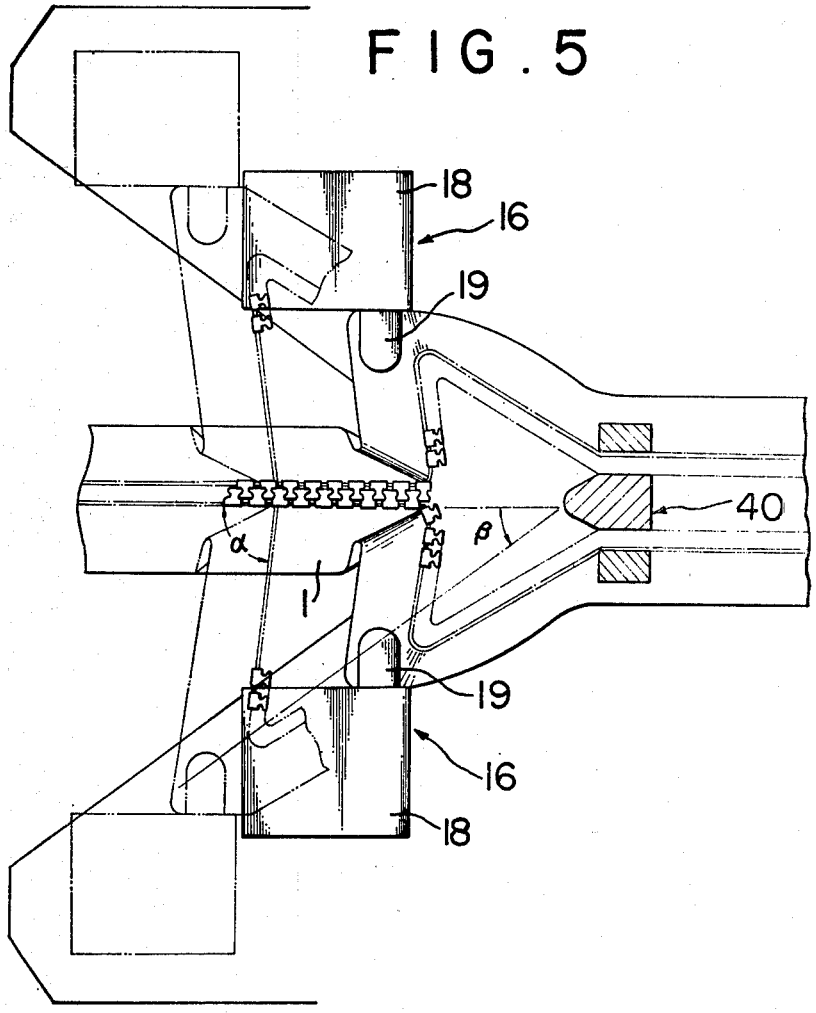
FIG. 5 is a plan view illustrating the principle of tape-abstracting.
Figure 6A:
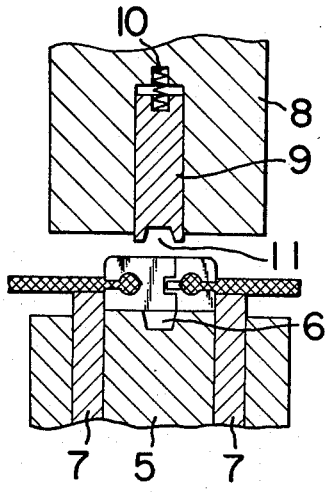
FIG. 6(*a*) to FIG. 6(*d*) are cross sectional views illustrating the function of the punch-die unit.
Figure 6B:
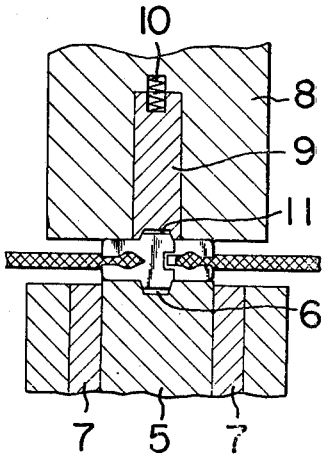
Figure 6C:
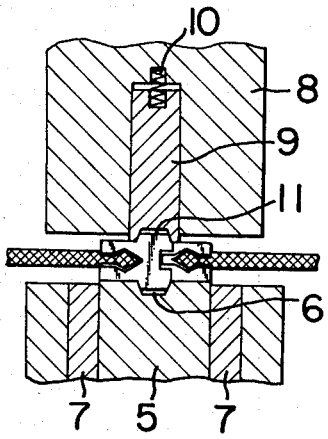
Figure 6D:
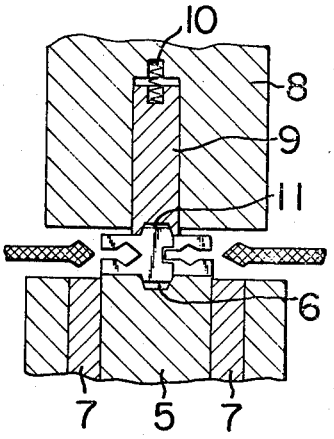

The principle of operation is illustrated in FIG. 5. Each of the carrier tapes of the slide fastener chain 1 is pulled by a gripper jaw 18 at an abstracting angle $\alpha$ relative to the row of the elements, while the gripper jaw 19 of a gripper mechanism 16 held by a holder 18 moves in a direction shown by the straight chain line at an angle $\beta$ relative to the direction of the row of the elements to the positions shown in phantom lines. Thus the abstracting angle $\alpha$ is constant for all of the elements within the section regardless of the positions of the individual elements within the section when the angle $\beta$ is about a half of the angle $\alpha$.

In the apparatus of the invention, the punch-die unit 2 is positioned at the center of a base 4 and includes a die 5 having a recessed groove 6 on the upper surface thereof along its center line, a pair of vertically movable element guides 7 being provided in parallel at both sides of the recessed groove 6, which are capable of projecting above the upper surface of the die 5 from their illustrated flush position.

The punch of the punch-die unit 2 is composed of an outer punch 8 and an inner punch 9 embedded within the former and capable of sliding to project from the lower surface of the outer punch 8 or to be received therein against the bias of a spring 10 disposed between the outer punch 8 and inner punch 9. A recessed groove 11 is provided on the lower surface of the inner punch 9 along the center line in a position in registration with the recessed groove 6 on the die 5.

These punches are fixed to a vertically movable bolster 13 by a punch holder 12 the movable bolster 13 being guided by a pair of guide posts 14 each having a guide sleeve 15.

The tape-abstracting mechanisms 3 are each composed of the gripper mechanism 16 for gripping the carrier tape and a driving mechanism 17 for displacing the gripper mechanism 16 toward the lateral side of the punch-die unit. Preferably a pair of the tape-abstracting mechanisms are provided at the right and left of the punch-die unit.

The gripper mechanism 16 comprises a pair of gripper jaws 19, 19' pivotally supported within the holder 18. Between the gripper jaws 19, 19' is a compression spring 20 at the gripping end and a ball 21 is embedded with a play at the opposite ends.

The ball 21 is disposed with a play in a central opening in an actuating plate 22, which is pivotally supported at one end, which has a cam surface at the other end, and which extends between the gripper jaws 19, 19'. The cam surface of the actuating plate 22 is engaged with a V-shaped opening at the end of a link 26 (FIG. 2) connected to a driving rod 23 through another link 24 and a shaft 25 fixed to the links 24 and 26 and pivotally supported on the base 4.

The ball 21 is moved between the gripper jaws 19, 19' in response to the position of the actuating plate 22. Upward movement of the driving rod 23 pivots the links 24, 26, the latter acting on the cam surface of the actuating plate 22 to close the gripper jaws 19,19' against the bais of the spring 20. The spring 20 opens the gripper jaws 19,19' when the ball 21 is restored to its original position by the downward movement of the driving rod 23.

The driving mechanism 17 of the gripper coverts the reciprocating movement of a pushing rod 27 in parallel with the longitudinal direction of the punch-die unit 2 into the movement of the gripper holder 18 along an oblong guide hole 28 (FIG. 2) extending from the front of the punch-die unit 2 toward an obliquely rearward position.

At an end of a pushing rod 27, a pinion 31 (FIGS. 3 and 4) is pivotally supported and which meshes with a rack 30 fixed to a frame 29 and the pinion 31 is engaged with a sliding rack 33 supported to enable sliding movement between a pair of guides 32, 32' fixed to the base 4. The sliding rack 33 is connected to a link 34 by a pin 35 and the link 34 has a guide protrusion 36 at the other end, the protrusion 36 being being disposed in a groove along one of the oblong guide holes 28 is a guide plate 37 in a V-wise disposition.

The gripper holder 18 is fixedly provided on the bottom surface thereof with a member having another guide protrusion 38 which is also engaged with the groove along one of the oblong guide holes 28 in the guide plae 37. The guide protrusions 36, 38 are connected to each other with a pin 39 extending through the oblong guide hole 28.

The reciprocating movement of the pushing rod 27 is converted to the reciprocating movement of the gripper holder 18 along the oblong guide hole 28 through the pinion 31, the rack 30, the sliding rack 33 and the link 34. Meanwhile the reciprocating movement of the gripper holder 18, i.e. the tape-abstracting mechanism 3, is along a straight line.

The above description of the example relates to the formation of the space sections on a continuous length slide fastener chain, but this invention is applicable also to the formation of space sections on a single continuous length of slide fastener stringer.

A slide fastener chain 1 having plastic fastener elements is introduced on the die 5 from the left in FIG. 2 where the leading end of the slide fastener chain is disassembled into the individual stringers which are separately passed through a separator 40 to position the slide fastener chain 1. In the next step, a pair of element guides 7 are raised to project above the upper surface of the die 5 followed by foward shifting of the slide fastener chain by a predetermined distance, after which the element guides 7 are lowered to place the slide fastener chain on the die (FIG. 6*(a)*) and the gripper mechanisms are operated to grip the carrier tapes.

Then the outer punch 8 and the inner punch 9 are lowered together to deform the plastic fastener elements, especially at the leg portions (FIG. 6(*b*)) and the outer punch 8 is slightly raised to release the leg portions of the elements (FIG. 6(*c*). In this stage, the elements are engaged with the recessed grooves 6, 11 on the upper surface of the die 5 and on the lower surface of the inner punch 9, respectively, at their deformed and raised head portions. Thereupon the gripper mechanisms 16 are moved along the oblong guide holes 28 so that the carrier tapes are pulled and moved from the front of the punch-die unit 2 toward the obliquely rearward positions to abstract the carrier tapes from the elements within the section where the deformed elements are fixedly engaged with the inner punch 9 (FIG. 6(*d*)). In this case, as shown in FIG. 5, an advantage is obtained by having the angle $\beta$ between the line of movement of the gripper mechanism 16 and the longitudinal center line of the punch-die unit 2 equal to a half of the abstracting angle $\alpha$ so that a uniform abstracting angle $\alpha$ is ensured for all of the elements to be removed from the carrier tape so that the finishing of the space formation is performed under uniform operational conditions throughout the space section. Subsequently the gripper mechanisms 16 are restored to their original positions where the carrier tapes are released from the grippers and the same procedure is repeated beginning with the elevation of the element guides 7 to convey the slide fastener chain by a predetermined distance. The elements removed from the carrier tapes are discharged out of the die 5 through the element guides 7 by the moving fastener chain 1.

The disadvantages of the prior art are eliminated and even the element at the rearmost position within the section for the space can be removed reliably from the carrier tape by use of the method and apparatus of the present invention in which the abstracting angle $\alpha$ is an acute angle for all of the elements to be removed with small difference among the elements since the carrier tapes are pulled and moved from the front of the starting elements within the section toward obliquely rearward direction of the rearmost elements. In particular, an advantage is obtained in that all of the elements are removed under uniform conditions with a constant abstracting angle of the tape when the angle between the line of movement of the tape and the longitudinal center line of the punch-die unit $\beta$ is equal to a half of the abstracting angle $\alpha$.

What is claimed is:

1. A method for forming a space section in a slide fastener having plastic interlocking elements with leg portions fixedly secured to a carrier tape, the elements in the prospective space section including a first element next to an element ahead of it, and a last element next to an element behind it, said method comprising:

(a) pressing the elements within the prospective space section at the leg portions thereof to deform the elements;

(b) holding the deformed elements in a fixed position; and (c) displacing the carrier tape by gripping it at a point ahead of said first element, and moving said gripped point of the tape rearwardly at an oblique displacement angle with respect to the held elements, and at a constant abstracting angle, until the carrier tape has been abstracted from said last element.

2. A method according to claim 1, wherein the angle of the displacement of the carrier tape relative to the row of held elements is about one-half of the abstracting angle of the carrier tape.

3. An apparatus for forming a space section in a slide fastener having plastic interlocking elements with leg portions fixedly secured to a carrier tape comprising:

(a) a punch-die unit having a longitudinal centerline along which the slie fastener can pass in a longitudinal path, and having such length along said centerline so as to be engageable with said leg portions in the prospective space section; and (b) a tape-abstracting mechanism positioned adjacent to said punch-die unit at a lateral side of said path, said mechanism including (1) a gripper mechanism for pulling on the tape at an abstracting angle, (2) a linkage connecting said punch-die unit to said gripper mechanism for joint operation, and (3) a driving mechanism connected to said gripper mechanism to translate it at an oblique angle from a point in front of the punch-die unit in a rearward direction.

4. An apparatus according to claim 3, including a second said tape-abstracting mechanism disposed at the opposite lateral side of said path.

5. An apparatus according to claim 4, including a pair of means respectively guiding the translations of said gripper mechanism in diverging straight lines.

6. An apparatus according to claim 5, said oblique angles between said diverging straight lines and said centerline being about one-half the respective abstracting angle.

7. An apparatus according to claim 3, including means for guiding the translation of said gripper mechanism in a straight line.

8. An apparatus according to claim 7, said oblique angle between said straight line and said centerline being about one-half of said abtracting angle.

9. An apparatus according to claim 3, said punch-die unit including:

(a) a die having an upwardly opening longitudinal groove extending along said centerline;

(b) a longitudinal punch facing said die and movable with respect to said die;

(c) an inner punch disposed in said longitudinal punch, and yieldably biased with respect thereto toward said die to enable it to prject from said longitudinal punch, said inner punch having a downwardly opening longitudinal groove in registration with the longitudinal groove of said die.

* * * * *